United States Patent [19]

Lambert

[11] 4,107,799

[45] Aug. 22, 1978

[54] WATERBED AND FRAME WITH PLIANT SUPPORTING SIDES

[75] Inventor: Everette M. Lambert, Santa Clara, Calif.

[73] Assignee: Liberty Vinyl Corporation, Santa Clara, Calif.

[21] Appl. No.: 792,827

[22] Filed: May 2, 1977

[51] Int. Cl.[2] ..... A47C 27/08

[52] U.S. Cl. ..... 5/370; 5/350; 5/371

[58] Field of Search ..... 5/349, 350, 365–371

[56] References Cited

U.S. PATENT DOCUMENTS

| | | | |
|---|---|---|---|
| 3,742,531 | 7/1973 | Alsbury | 5/370 |
| 3,789,442 | 2/1974 | Tobinick | 5/371 |
| 4,015,299 | 4/1977 | Tinnel | 5/370 |

OTHER PUBLICATIONS

Oil Bed, Apr. 1976, p. 87 by Stepley.

*Primary Examiner*—Casmir A. Nunberg
*Attorney, Agent, or Firm*—Townsend and Townsend

[57] ABSTRACT

A waterbed is disclosed which has a frame with a self-supporting bulkhead forming a safety lining. The bulkhead comprises two connected wedge-shaped members which are made of pliant material, and are held in place by a resilient membrane. A base member is anchored to a rigid backing or baseboard. A unitary resilient nonporous membrane is fastened to the edges of the baseboard and drawn tautly across the baseboard over the base member. A lateral member rests upon the base member and is sealed to the underlying membrane at the inwardly disposed margin of the lateral member, which is outboard of the inner boundary of the base member. The lateral member comprises a polyvinylchloride or like nonporous thermoplastic tube enclosing a polyurethane or like pliant member. The waterbed mattress comprises a bladder having a wedge-shaped margin conforming with the inwardly disposed wedge-shaped edge of the frame bulkhead. The corners of the mattress are tapered to conform with countersunk, inwardly disposed corners of the frame. The membrane and covering material of the frame and mattress are preferably made of nonporous thermoplastic materials suitable for dielectric heat sealing. A waterbed and waterbed frame manufactured according to the invention minimizes the lateral sag which accompanies the lateral loading on the bulkhead because tension is uniformly maintained by the underlying membrane stretched across the base member. Further, the sealed lining of the bulkhead forms the safety lining required by law.

11 Claims, 3 Drawing Figures

WATERBED AND FRAME WITH PLIANT SUPPORTING SIDES

BACKGROUND OF THE INVENTION

This invention relates to waterbed mattresses and frames, and particularly to a waterbed mattress and frame combination suitable for use with conventional fitted corner bedding.

Waterbeds, or fluid floatation sleeping systems, have become increasingly popular in recent years. A waterbed provides comfortably uniform support to the supine body. However, the basic waterbed has certain disadvantages which have limited the appeal and market. Traditionally, waterbeds have required rigid vertical bulkheads to hold the shape of the fluid filled bladder. Beds having high, rigid sideboards are very uncomfortable to sit on, and it is difficult to get into and out of such a bed. Further, it is extremely difficult to use form fitted conventional sheets and bedding, since the edges of the mattress tend to deform when pressurized unevenly.

Very recently, waterbed designs have been proposed which overcome some of these problems. For example, Intimate Sleep Products of Santa Clara, California, has introduced a waterbed having a foam frame for use with a water mattress. The foam frame includes a rigid bulkhead separating the foam edge from the water mattress to prevent the lateral sag which would be characteristic of a water mattress without adequate lateral support. Unfortunately, the bulkhead protrudes vertically and "bottoms out" adjacent the edge, which is uncomfortable to anyone who is sitting on or resting on or near an edge of the bed, further, the mattress "bottoms out" at the center because of the relatively shallow mattress.

In order to overcome some of these problems and to further provide a structure geared to attract people who prefer conventional furniture and bedding, a number of waterbed structures have been proposed which imitate the appearance and convenience of a conventional mattress and foundation combination. For example, the Watercloud Bed Company of Huntington Beach, California, has developed a frame without rigid sides. The frame includes four separable foam filled-wedge-shaped sides which lock together in position on a deck. A separate safety liner is required, which must be placed within the mattress-receiving cavity of the frame.

A further type of pliant-sided frame is identified as the "Sleeper" by its manufacturer, Custom Designs of Buena Park, California. The frame includes a separable fiberglass base and a separable foam railing which rests on the fiberglass base. Both the "Sleeper" and the Watercloud designs are constructed for use with conventional bedding and appear suitable in a conventional bedroom set.

Both the Watercloud and Custom Designs mattress systems have distinct disadvantages. The "Sleeper", due to its fiberglass base tends to "bottom out" at its edges. Further, the foam railing of both the "Sleeper" and the Watercloud mattress tend to bow under the load of a water mattress. This presents a major problem structurally, and is aesthetically displeasing. Furthermore, both require an additional safety lining.

SUMMARY OF THE INVENTION

In order to overcome the problems of the prior art, a waterbed is provided which has a frame with a self-supporting bulkhead forming a safety lining. The bulkhead comprises two connected wedge-shaped members ringing the mattress area to form a mattress-receiving cavity which are made of polyurethane foam or like pliant material, namely a base member and an overlying lateral member. The base member is anchored to a rigid backing or baseboard. A single resilient nonporous membrane is fastened to the edges of the baseboard and is drawn tautly across the baseboard over the base member. The lateral member rests upon the base member and is sealed to the underlying membrane at the inwardly disposed margin of the lateral member, which is outboard of the inner boundary of the base member. The lateral member comprises a polyvinylchloride or like nonporous annular tube enclosing a polyurethane or like pliant rib. The water mattress comprises a bladder having a wedge-shaped margin conforming with the inwardly disposed wedge-shaped edge of the frame bulkhead. The corners of the water mattress are tapered to conform with countersunk, inwardly disposed corners of the frame. The membrane and covering material of the frame and mattress are preferably made of nonporous thermoplastic material suitable for dielectric heat sealing and which are capable of holding a substantial tension load.

A waterbed and waterbed frame according to the invention minimizes the lateral sag which accompanies the lateral loading of the bulkhead since tension is uniformly maintained by the taut underlying membrane stretched across the base member. Further support is provided by the enhanced strength of the single tube bulkhead member. The vertical load of the water or like fluid on the lateral bulkhead member also helps to hold down the bulkhead edges. The mattress is wedge-shaped with sufficient depth to prevent "bottoming out" at the center of the bed. The totally pliant bulkhead also eliminates the undesirable and uncomfortable "bottoming out" at the edges. The mattress and frame can be used with conventional mattress ticking and bedding in a conventional bedroom set, since the edges are of firm, relatively narrow foam. The mattress ticking and bedding are held within the crease between the base member and the lateral member of the bulkhead. Further, the sealed bulkhead forms the safety lining required by law.

Further objects and advantages of the invention will be clear upon reference to the following detailed description taken in conjunction with the accompanying drawings.

DETAILED DESCRIPTION WITH PREFERRED EMBODIMENTS

Figure 1:
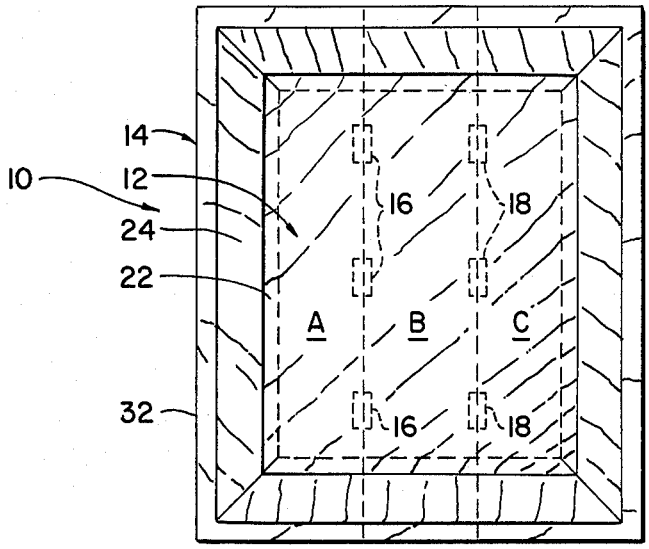
FIG. 1 is a top plan view of the waterbed frame according to the invention.
Figure 2:
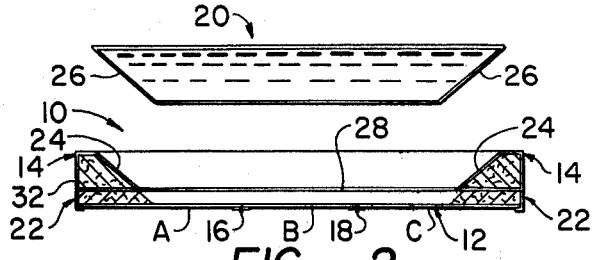
FIG. 2 shows an exploded side cross sectional view of the waterbed frame and water mattress according to the invention.

Referencing FIGS. 1 and 2, a waterbed mattress frame 10 is shown with a baseboard 12 and a rim 14. The baseboard 12 may be divided into three parallel segments A, B and C which are hinged to one another with hinges 16 and 18. The baseboard 12 may be made of a material such as wood or the like suitable for supporting the distributed load of a fluid filled mattress 20 having wedge-shaped margins.

The rim 14 includes two bulkhead portions disposed about the periphery baseboard 12 and overlying one another. The first bulkhead portion is a base member 22 made of a deformable pliant material such as polyurethane foam. The second or overlying member is a tube 32 tightly filled with pliant formable material such as polyurethane foam. The tube is preferably a nonporous thermoplastic such as polyvinylchloride. The base member 22 and lateral member 24 define, in vertical cross section, a trapezoid conforming to wedge-shaped lateral margins 26 of mattress 20. The depth of mattress 20 is generally about 10–14 inches and the length of the wedge-shaped face of edge 26 is generally about 14 to 20 inches. However, the depth of the lateral member 24 is generally about the thickness of a conventional mattress. Conventional mattress ticking and bedding may be placed over the top surface of a water mattress, which is laid into the rim and the edges may be drawn to conform to the corners and the sides of the lateral member 24 to give the appearance of a conventional mattress. "Bottoming out" of the mattress is minimized because the wedge-shaped mattress 20 is deeper than the conventional mattress.

According to the invention, a horizontal retaining means or resilient membrane 28 is provided across the rim 14 between base member 22 and lateral member 24. Membrane 28 is drawn tautly across the rim 14 for carrying a tension load of mattress 20.

Figure 3:
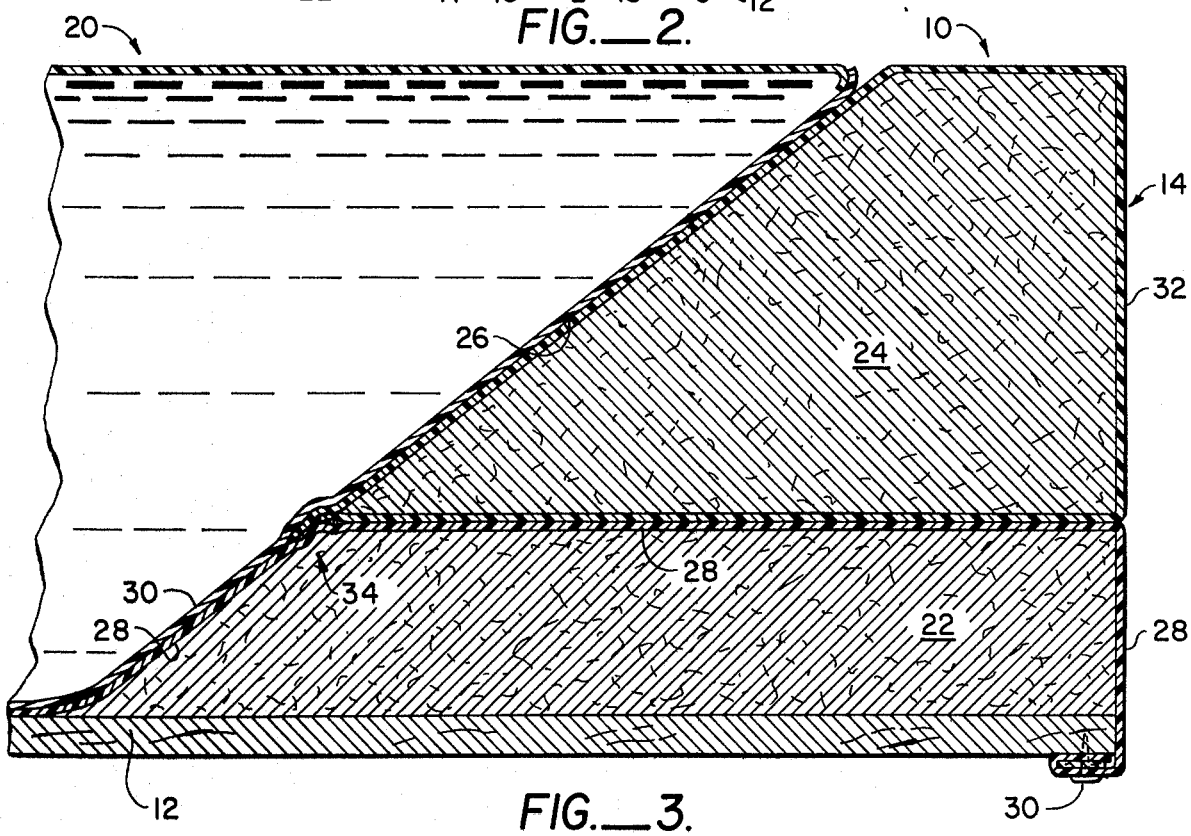
FIG. 3 illustrates a side cross sectional view of a detail of the waterbed frame and mattress.

Referring particularly to FIG. 3, the details of the inventive features are illustrated. Membrane 28 is shown to be stretched into conformance with the surface of baseboard 12 and base member 22 by downwardly and laterally directed force imposed by the weight of mattress 20. Membrane 28 is fastened at the edge of baseboard 12 reinforced hem 30 and is drawn over the surface of base member 22 forming a covering.

Lateral member 24 includes as a skin imperforate tube 32 made of thermoplastic such as polyvinylchloride or the like. The tube 32 tightly encases preformed polyurethane foam, and tube 32 if preferably a unitary annulus in order to enhance structural supportability. The tube 32 is preferably sealed by dielectric heat sealing means under virtually no surface tension. In order to enclose polyurethane foam under tension, it is first necessary to compress the foam in a press or the like until such time as the tube 32 is sealed to set to alleviate problems in deformation of the skin 32 during the sealing process.

An important feature of the invention is illustrated at an inwardly disposed corner of lateral member 24, particularly at a junction 34 with base member 22. At junction 34, membrane 28 is sealed, as by dielectric heat sealing, with tube 32 providing a continuous horizontally sealed bond along the inwardly disposed surface of rim 14. Bonded junction 34 provides the sole structural support point for lateral member 24, tube 32 being in effect a continuation of membrane 28. To the extent that tube 32 and membrane 28 are imperforate, the combination is a safety lining, which is required by law. Thus, further provision for safety lining is unnecessary.

Certain particular advantages are derived from a waterbed frame with a rim 14 according to the present design. In particular the rim 14 is deformable, i.e. compressible in the vertical direction, rim 14 is substantially immune from lateral deformation, i.e. bulging due to lateral loading of mattress 20. This feature is derived from a number of factors. First, is the lateral structural support of the membrane 28 in combination with tube 32. Membrane 28 and tube 32 are maintained under tension by the load of mattress 20, which tends to counteract the laterally outwardly directed forces of mattress 20.

Second, the wedge shape of the edges of the mattress 20 and the complimentary shape of rim 14 cooperate so that the lateral loading of mattress 20 throughout its depth generally equalizes the load-bearing ability of rim 14. Rim 14 is narrowest at the top where lateral loading is the least while widest at the bottom where lateral loading may be expected to be greatest.

Third, with conventional mattress ticking drawn over the top of the mattress 20 and frame 10, the water mattress and foam frame combination gives the appearance of a conventional mattress and boxsprings. Moreover, the combination includes a particular desirable feature of a conventional mattress and box springs. Namely, it is relatively easy to climb on and off the bedsides since the edges provide relatively firm support without interference of an uncomfortable vertical area below or within the area of the edges.

Finally, the edges may be laid upon without the discomfort of a hardened ridge or abruptly shallower undercarriage. Lateral support is provided by a vertically pliant, yet laterally firm bulkhead region.

The invention has now been explained with reference to particular embodiments, but other embodiments will be apparent to those of ordinary skill in the art in light of this disclosure. For example, the horizontal retaining means may comprise a plurality of ribbons or straps drawn across the baseboard attached to the lateral member. It is therefore not intended that the invention be limited except as indicated by the appended claims.

I claim:

1. In a frame for a fluid filled mattress, said frame having a horizontally flexible bulkhead about a frame periphery, the improvement comprising longitudinally resilient retaining means secured under tension to opposing peripheral portions of said bulkhead and adapted to support from below said mattress for minimizing horizontal flexture of said bulkhead.

2. An improvement according to claim 2 wherein said retaining means comprises a sheet attached to said bulkhead peripheral portions.

3. An improvement according to claim 2 wherein said sheet is a nonporous membrane sealably bonded to said bulkhead, said bulkhead also being nonporous to provide a safety reservoir for said fluid filled mattress.

4. Means for supporting a fluid filled mattress having lateral surfaces and a generally flat bottom surface, said supporting means comprising:

a. means for bearing a first circumferential portion of said mattress lateral surfaces, said first lateral surface bearing means being of a pliant deformable cushion material;

b. means for bearing a second circumferential portion of said lateral surfaces, said second lateral surface bearing means overlying said first lateral surface bearing means, said second lateral surface bearing means being of a pliant deformable cushion mateiral; and c. horizontal retaining means in part overlying said first lateral bearing means and secured to opposing circumferential portions of said lateral surface bearing means such that an inwardly drawing force bears upon said lateral surface bearing means upon loading of said retaining means by said mattress.

5. A fluid filled mattress supporting means according to claim 4 wherein said retaining means is for being drawn tautly between opposing circumferential portions of said first lateral surface bearing means.

6. A fluid filled mattress supporting means according to claim 5 wherein said retaining means comprises a nonporous membrane, and wherein second lateral surface bearing means includes a nonporous membrane along the inwardly disposed margin, said nonporous membranes being sealably attached to form a reservoir for confining said mattress.

7. A fluid filled mattress supporting means according to claim 6 wherein said first and second lateral surface bearing means together define in nondeformed cross section a trapezoid having an inwardly disposed tapering side for mating with a complementary wedge-shaped side of an overlying fluid filled mattress, and wherein said retaining means and said second lateral surface bearing means are bonded along said inwardly disposed side adjacent a mating corner of said first and second lateral surface bearing means to provide a separable confronting horizontal margin along the outwardly disposed side for receiving and holding bedding under weight of said mattress.

8. For use with a fluid filled mattress having weight and having tapered lateral sides, a frame comprising:

a baseboard having an obverse face with lateral margins;

a base member having an inboard margin and an outboard margin, said base member circumscribing said lateral margins on said obverse face, said base member being of a pliant deformable cushion material;

a unitary membrane of a substantially imperforate pliant and resilient plastic sheet material, said membrane being drawn tautly across said obverse face overlying said base member;

a lateral member including a substantially imperforate pliant tube having an inboard margin and an outboard margin, said tube substantially enclosing pliant deformable cushion material, said lateral member overlying said base member along said base board lateral margins, said tube being sealed along said tube inboard margin to said membrane adjacent said base member inboard margin to define a generally horizontal crease terminating at said outboard margins and a reservoir within said tube inboard margin and said membrane, said inboard margins of said base member and said lateral member conforming with said tapered lateral sides of said mattress to hold said mattress such that the force of said mattress draws inwardly said base member and said lateral member for bearing the lateral load of said mattress.

9. A method for maintaining a uniform lateral shape of a fluid filled mattress comprising:

surrounding said mattress with a ring;

stretching resilient load bearing means across said ring below said mattress; and securing under tension said load bearing means to said ring, for supporting said mattress while providing an inwardly directed force for bearing the lateral load of said mattress.

10. Apparatus for supporting a fluid filled mattress having lateral surfaces, said supporting means comprising:

means for bearing said lateral surfaces;

retaining means suspended under tension between opposing circumferential portions of said bearing means for retaining said bearing means in substantially fixed horizontal relation and for supporting said mattress.

11. Apparatus according to claim 10 wherein said retaining means includes a sheet material.

* * * * *